United States Patent [19]

Adalbert et al.

[11] Patent Number: 4,505,656

[45] Date of Patent: Mar. 19, 1985

[54] VANE COMPRESSOR, PARTICULARLY A COOLING MEDIUM COMPRESSOR FOR USE IN AIR-CONDITIONING EQUIPMENT OF A VEHICLE

[75] Inventors: Gerhard Adalbert, Stuttgart; Theodoros Vysiotis, Bühl-Eisenthal, both of Fed. Rep. of Germany

[73] Assignee: Robert Bosch GmbH, Stuttgart, Fed. Rep. of Germany

[21] Appl. No.: 568,804

[22] Filed: Jan. 6, 1984

[30] Foreign Application Priority Data

Mar. 1, 1983 [DE] Fed. Rep. of Germany ... 8305665[U]

[51] Int. Cl.[3] ..... F16K 15/16; F04C 2/00

[52] U.S. Cl. ..... 418/270; 418/268

[58] Field of Search ..... 418/15, 270; 137/855–857

[56] References Cited

U.S. PATENT DOCUMENTS 3,200,838 8/1965 Sheaffer ..... 137/856
3,809,511 5/1974 Linder ..... 418/259
4,168,722 9/1979 Mayer ..... 137/856
4,257,458 3/1981 Kondo ..... 137/855

FOREIGN PATENT DOCUMENTS 2349651 4/1975 Fed. Rep. of Germany .

*Primary Examiner*—Leonard E. Smith
*Assistant Examiner*—Jane E. Obee
*Attorney, Agent, or Firm*—Michael J. Striker

[57] ABSTRACT

In a rotary vane compressor of the type including a rotor formed with a plurality of radial vanes and positioned in an inner wall of the housing, with which wall the rotor forms a working chamber with a low pressure portion and a high pressure portion, a plurality of colling medium-outlet bores, formed in the housing inner wall and associated with the high pressure portion, are arranged in recesses provided in the inner wall and open at the outer side thereof. These recesses accommodate flap valves normally closing the outlet bores. A number of reinforcing ribs are formed on the inner wall of the housing which separate the adjacent recesses from each other.

5 Claims, 2 Drawing Figures

VANE COMPRESSOR, PARTICULARLY A COOLING MEDIUM COMPRESSOR FOR USE IN AIR-CONDITIONING EQUIPMENT OF A VEHICLE

BACKGROUND OF THE INVENTION

The present invention relates to a vane compressor, especially a cooling medium-compressor to be utilized in a vehicle climate-control arrangement.

Vane compressors of the foregoing type have been known in the art. Such vane compressors are disclosed, for example in U.S. Pat. Nos. 3,809,511; 3,834,846; 3,852,003; 3,989,490 and 4,103,506.

German patent publication DE-OS No. 2349651 discloses a vane compressor in which outlet bores arranged on generatrix of the inner surface of the wall of the housing, forming working chambers with the outer surface of the rotor, open into the bottoms of cylindrical depressions formed in that wall. The valve members of the valves are arranged at the discharge ends of individual outlet bores to close the latter. In this construction residual gas volume is held very insignificantly in the interiors of the valves. The disadvantage of this known construction is that it is very expensive because its manufacture involves a number of machining operations.

SUMMARY OF THE INVENTION

It is an object of this invention to provide a vane compressor which can be economically manufactured, particularly in the region of outlet bores.

This and other objects of the invention are attained by a rotary vane compressor, particularly for a cooling medium for use in air-conditioning installation of a vehicle, comprising an outer housing wall and an inner housing cylindrical wall radially spaced from each other; said inner wall having an endless inner surface; a rotor disposed in said inner wall and having an outer surface, said rotor forming between the outer surface thereof and said inner surface of said inner wall at least one working chamber having a low pressure portion and a high pressure portion, said rotor having a plurality of radial slots; a plurality of vanes positioned in said slots and slidingly engaging said inner surface of the inner wall to subdivide said working chamber into a plurality of medium-conveying cells; medium inlet means opening into said low pressure portion; at least two outlet bores formed in said inner wall and connected to the high pressure portion and arranged at said inner surface of said inner wall, each of said bores being provided with a pressure valve normally closing the outlet bore, said inner wall having an outer side and formed with at least two recesses, open at said outer side and each accommodating a respective pressure valve, each of the outlet bores being connected to a respective recess, said inner wall being formed with reinforcing ribs formed according to an original thickness of said inner wall, each recess being separated from a neighboring recess by a respective reinforcing rib.

The valve arrangement in the vane compressor according to the invention provides for a significant reinforcement of the housing inner wall in the region of the outlet openings. The outer surface of the wall is substantially increased due to the provision of the ribs whereby heat-removal is significantly improved, particularly when the stator is formed of leight metal alloys. Furthermore, due to a reduction of a residual gas volume a lower drive output and a lower compression end temperature are obtained.

According to a further concept of the invention each recess may have a flat base which forms a supporting surface for the respective pressure valve. The pressure valves may be flap valves.

The flat base may extend parallel to a plane which is tangent to the inner surface of said inner wall in the region of the respective outlet bore.

Furthermore, the bases of all said recesses may lie in one plane, said recesses being connected to each other in said one plane in the region facing away from the outlet bores. Due to such an arrangement of the recesses and the flap valves therein a comb-like valve unit for outlet bores can be formed, for example as in U.S. Pat. No. 3,809,511.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
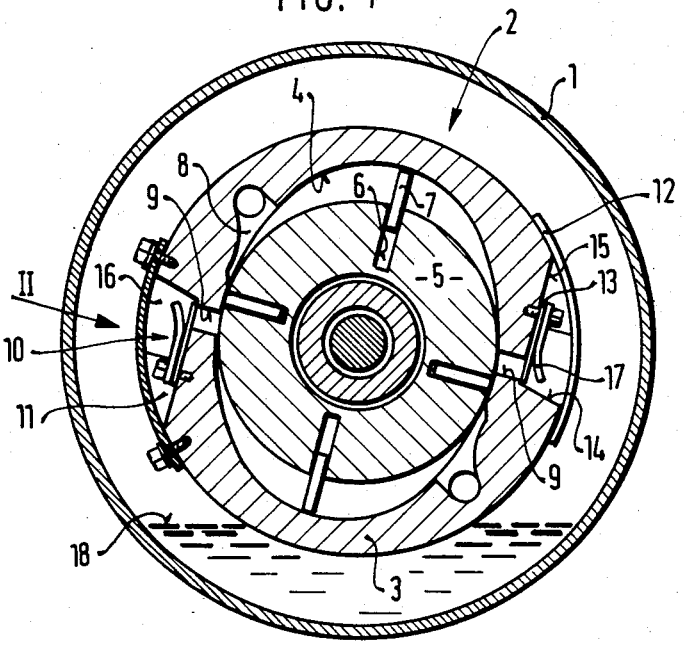
FIG. 1 is a traverse cross-sectional view through a vane compressor with two diametrally opposing working chambers.

The vane compressor is of the type in which the vanes divide the working space between the rotor and the housing into high pressure and low pressure chambers communicating with outlet and inlet passages in the form of a plurality of bores through the inner wall surrounding the rotor and guiding the vanes. The outlet bores are opened and closed by valves.

Referring now to the drawings in detail reference character 1 designates an outer housing of the vane compressor, in which a central housing part 2 is arranged. Housing part 2 has a wall 3 which encloses a cylindrical chamber or cavity 4 formed in the interior of housing part 2. A rotor 5 mounted on a rotor shaft driven by a suitable motor in the conventional manner is positioned in cavity 4. The latter is defined by a mathematically determined, for example eliptical, endless cam surface which forms a curve of the stroke of the compressor. The cylindrical rotor 5, which extends in the housing cavity 4, has a diameter which corresponds to the length of the smaller axis of the ellipsoidal inner surface of housing part 2 forming the housing cavity 4. Two crescent-shaped and diametrically opposing working chambers are thus formed in the housing cavity 4 between the outer surface of rotor 5 and the inner surface of wall 3.

Rotor 5 is formed with a plurality of radial slots 6 in which are seal-tightly but slidably mounted vanes 7. Vanes 7 are pressed with their outer edges against the cylindrical peripheral wall of internal chamber 4 and subdivide each of the two working chambers into individual cells. Each of the two sickel-shaped working chambers has a suction, or low-pressure portion and a high pressure portion. Each low pressure portion is connected by means of a respective inlet 8 to a feed conduit of the compressor in the known fashion. The high pressure portion of each working chamber is provided with a respective outlet bore 9; bores 9 being arranged on a generatrix of the inner cylindrical surface of chamber 4. Outlet bores 9 are connected to a respective pressure passage 11 via a respective valve 10. Each pressure passage 11 extends within a hood 12 fastened to the outer side of housing part 2 by screws.

Figure 2:
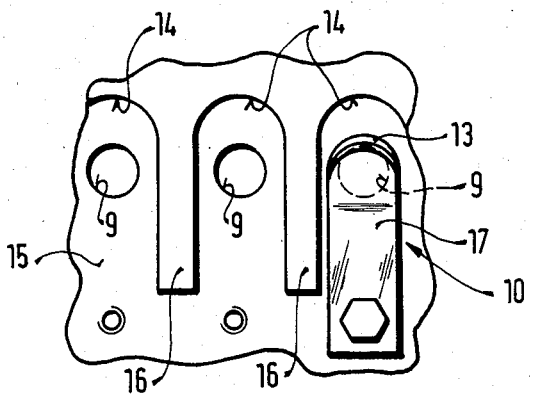
FIG. 2 is a partial side view seen from arrow II in FIG. 1 and illustrating a discharge valve region of the vane compressor.

Each pressure valve is arranged in a recess 14 formed in wall 3 and opening towards the outer side of wall 3 which forms chamber 4. Each recess 14 has a flat bottom or base 15. As seen from FIG. 1 the flat bottom 15 of each recess extends parallel to the plane which is tangent to the inner surface of cylindrical wall 3 in the region in which the respective outlet bore 9 is arranged. As shown in FIG. 2, the bottoms 15 of all recesses 14, in the area thereof facing away from outlet bores 9, are connected to each other by a single surface. Each recess 14 is separated from the neighboring recess by a respective reinforcing rib 16 formed according to the original thickness of wall 3. In order to render the formation of the above mentioned pressure passages 11 possible the reinforcing ribs 16 do not extend over the entire length of bottoms 15 of the respective recesses.

Each pressure valve 10 is comprised of an elastic tongue or flap-shaped valve member 13 adapted to close the outlet bore 9 at the side thereof facing away from rotor 5, and a lifting catcher 17 superposing the valve member 13. The valve member 13 and lifting catcher 17 are in the usual manner secured to the respective bottom 15 of recess 14 by bolts.

Due to the above-described arrangement of all bottoms 15 of recesses 14 into one and single surface it is possible to combine all pressure valves 10 into a single comb-shaped valve structure, as for example known from applicants' U.S. Pat. No. 3,809,511.

Owing to the arrangement of pressure valves 10 in recesses 14, which are separated from each other by reinforcing ribs 16, the length of outlet bores 9 is limited to the least constructively possible dimension. A damaging space in the high pressure portion of each working chamber and the influence of the reverse expansion of residual gases which can collect therein are therefore minimized. The reinforcing ribs 16, on the other hand, substantially reinforce wall 3 in the region of recesses 14. Furthermore, reinforcing ribs 16 also act as heat-removing surfaces which is particularly favorable if housing part 2 is made out of light metal alloys.

An oil separator not described herein and, disclosed, for example in applicants U.S. Pat. No. 3,989,490 forms a connection between pressure passage 11 and the inner space of outer housing 1 in which an outlet of the compressor is arranged. Oil separated from a cooling medium in the oil separator in the known manner is collected in the lower region of outer housing 1 in which oil supply 18 is located.

During rotation of rotor 5 by a suitable drive motor vanes 7 move along the cylindrical inner surface of the inner wall 3 which forms chamber 4. The cells between two respective vanes expand so that the compressed cooling medium is sucked in through inlets 8. Upon further rotation of the rotor those cells between two respective vanes contract so that the compressed cooling medium is discharged through outlet bores 9 and the opened pressure valves 10. The pressure from outlet bores 9 displaces valve members 13 of valves 10 so that the medium can flow into pressure passages 11 in the known fashion.

It will be understood that each of the elements described above, or two or more together, may also find a useful application in other types of vane compressors differing from the types described above.

While the invention has been illustrated and described as embodied in a valve arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotary vane compressor, particularly for a cooling medium for use in air-conditioning installation of a vehicle, comprising an outer housing wall and an inner housing cylindrical wall radially spaced from each other, said inner wall having an endless inner surface; a rotor disposed in said inner wall and having an outer surface, said rotor forming between the outer surface thereof and said inner surface of said inner wall at least one working chamber having a low pressure portion and a high pressure portion, said rotor having a plurality of radial slots; a plurality of vanes positioned in said slots and slidingly engaging said inner surface of the inner wall to subdivide said working chamber into a plurality of medium-conveying cells; inlet means opening into said low pressure portion; at least two medium-outlet bores formed in said inner wall and connected to the high pressure portion and arranged at said inner surface of said inner wall, each of said bores being provided with a pressure valve normally closing the outlet bore, said inner wall having an outer side and formed with at least two recesses open at said outer side and each accommodating a respective pressure valve, each of the outlet bores being connected to a respective recess, said inner wall being formed with reinforcing ribs formed according to an original thickness of said inner wall, each recess being separated from a neighboring recess by a respective reinforcing rib.

2. The compressor as defined in claim 1, wherein each recess has a flat base which forms a supporting surface for the respective pressure valve.

3. The compressor as defined in claim 2, wherein said pressure valves are flap valves.

4. The compressor as defined in claim 3, wherein the flat base extends parallel to a plane which is tangent to the inner surface of said inner wall in the region of the respective outlet bore.

5. The compressor as defined in claim 2, wherein the bases of all said recesses lie in one plane, said recesses being connected to each other in said one plane in the region facing away from the outlet bores.

* * * * *